US005449169A

United States Patent [19]

Hardin et al.

[11] Patent Number: 5,449,169

[45] Date of Patent: Sep. 12, 1995

[54] RETRACTABLE DIVOT REPAIR TOOL

[76] Inventors: Claude R. Hardin, 212 Maple St., Rt. 3; Randy G. Hardin, P.O. Box 246, both of Hennessey, Okla. 73742

[21] Appl. No.: 355,856

[22] Filed: Dec. 14, 1994

[51] Int. Cl.[6] ..... A63B 57/00

[52] U.S. Cl. ..... 273/32 B

[58] Field of Search ..... 273/32 B

[56] References Cited

U.S. PATENT DOCUMENTS

| | | | |
|---|---|---|---|
| D. 247,056 | 1/1978 | McClaskie | D21/2 |
| D. 264,369 | 5/1982 | Jackson | D21/2 |
| D. 328,117 | 7/1992 | Haugom | D21/234 |
| 3,539,017 | 11/1970 | Johnson | 273/32 BX |
| 4,955,609 | 9/1990 | Kassen | 273/32 BX |
| 4,998,726 | 3/1991 | Budnick | 273/32 BX |
| 5,054,777 | 10/1991 | Borden et al. | 273/32 B |
| 5,143,371 | 9/1992 | Strahan | 273/32 B |
| 5,152,524 | 10/1992 | Brown | 273/32 B |
| 5,305,999 | 4/1994 | Tate | 273/32 B |
| 5,388,824 | 2/1995 | Reimers | 273/32 BX |

*Primary Examiner*—William H. Grieb

[57] ABSTRACT

A retractable divot repair tool assembly comprising a divot repair tool in a generally planar configuration, the tool having long parallel side edges, a short linear bottom edge coupling the side edges and an upper portion formed in a generally V-shaped configuration and with the lower portion of the tool being in a generally rectangular configuration of a length slightly less than the length of the upper V-shaped portion with an aperture therethrough and a recess in the aperture; a housing in a generally box-like configuration having rectangular front and rear walls, a bottom wall at right angles with respect thereto and parallel side walls coupling the side edges of the front and rear walls and the side edges of the bottom wall, the container having an opened upper end, the container also having a longitudinal slot on the front wall along the majority of its length thereof parallel with the side walls and with short upper and lower transverse slots adjacent to the upper end and lower end of the longitudinal slot; and mechanisms to move the divot repair tool between a stored orientation within the container and an operative orientation exterior of the container.

8 Claims, 6 Drawing Sheets

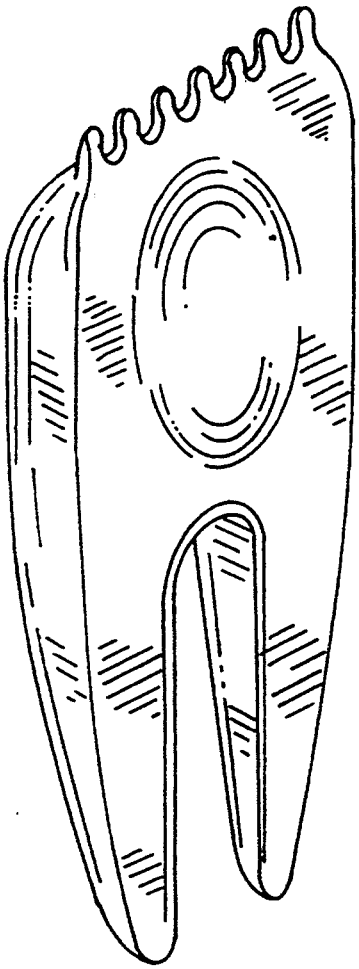
Fig. 1
PRIOR ART
Fig. 2
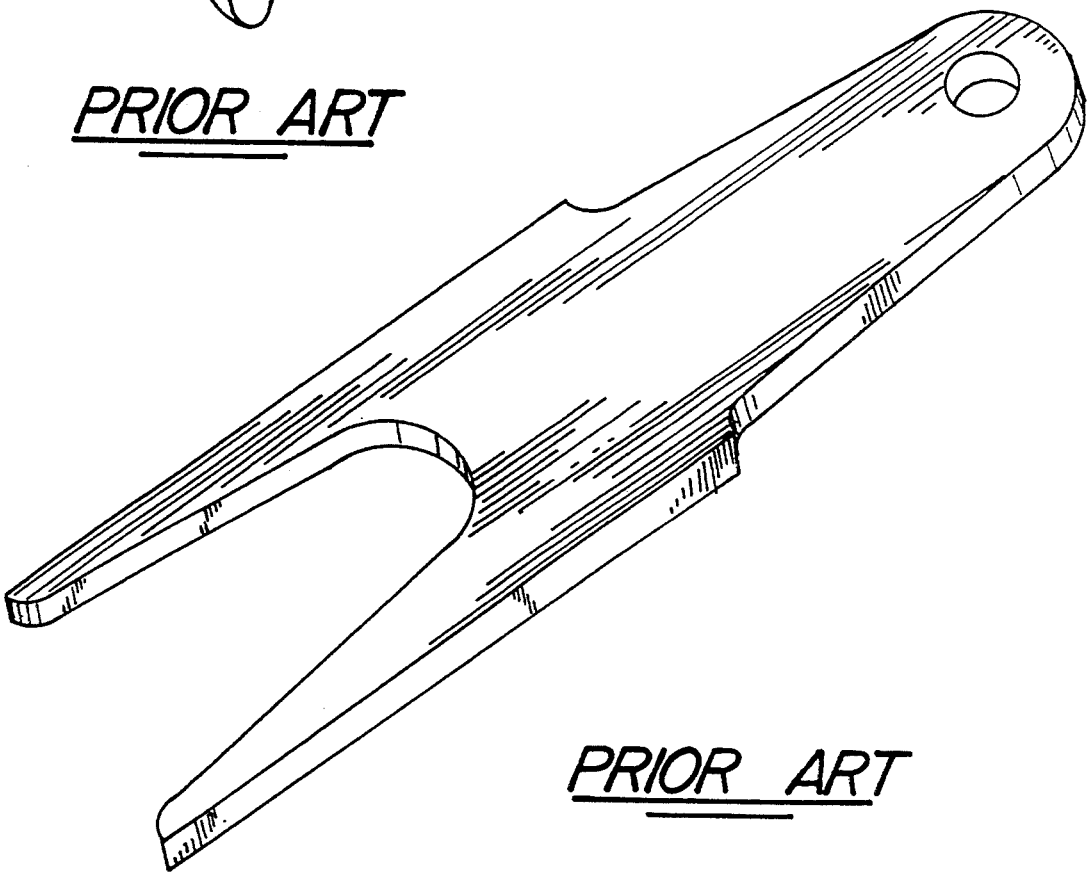
PRIOR ART

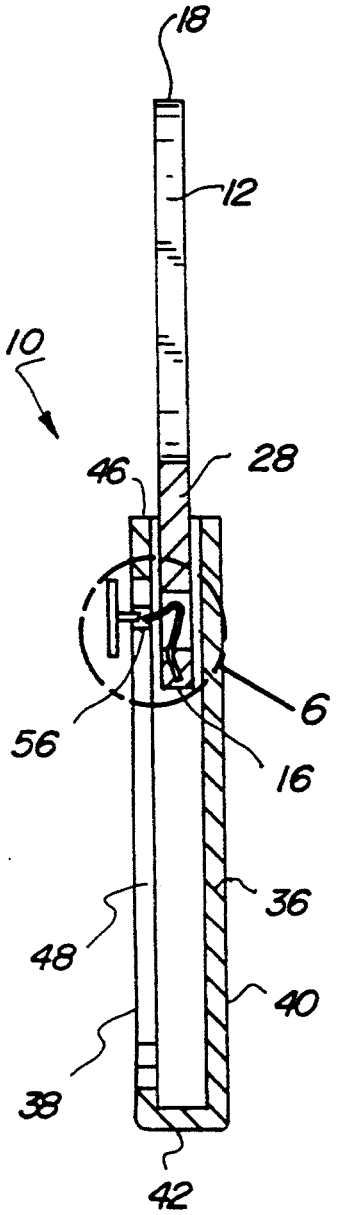
Fig. 5
Fig. 6
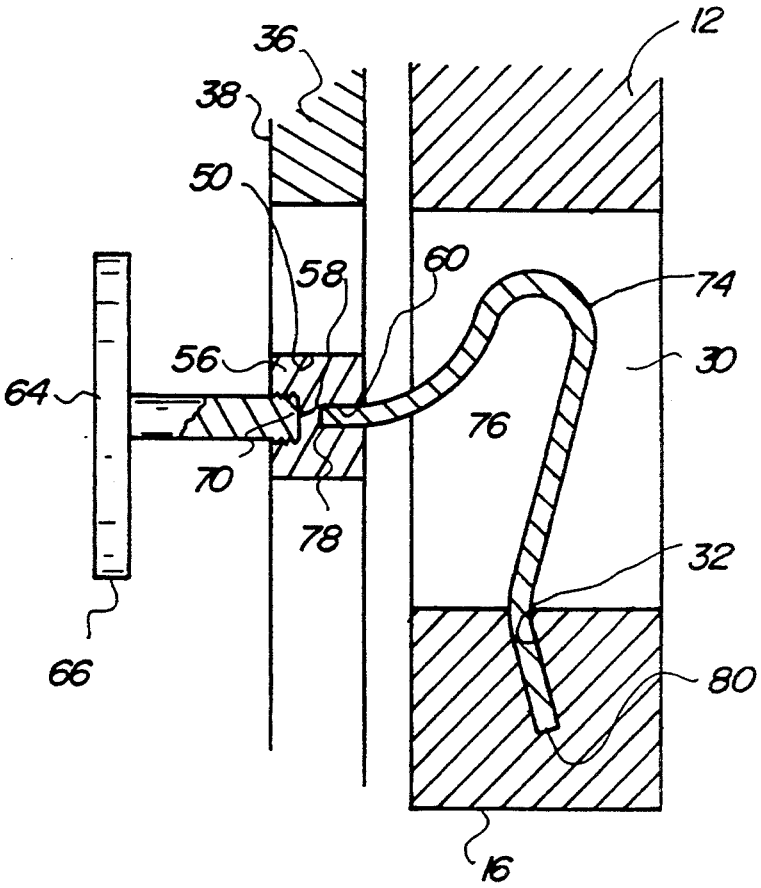

RETRACTABLE DIVOT REPAIR TOOL

BACKGROUND OF THE INVENTION

1. Field of the Invention

The present invention relates to a retractable divot repair tool and more particularly pertains to retractably supporting a divot repair tool in a container of the type capable of being used as a key ring, money clip or the like.

2. Description of the Prior Art

The use of retractable tools of a wide variety of designs and configurations is known in the prior art. More specifically, retractable tools of a wide variety of designs and configurations heretofore devised and utilized for the purpose of supporting tools in a container which allow for selective retraction and extension through a wide variety of methods and apparatuses are known to consist basically of familiar, expected, and obvious structural configurations, notwithstanding the myriad of designs encompassed by the crowded prior art which has been developed for the fulfillment of countless objectives and requirements.

By way of example, the prior art discloses in U.S. Pat. No. 5,054,777 a golf accessory including a divot repair.

U.S. Pat. No. 5,152,524 discloses another golf accessory device.

U.S. Pat. No. Des. 247,056 discloses the design of a divot repair tool for golfers.

U.S. Pat. No. Des. 264,369 discloses the design of a divot repair tool.

U.S. Pat. No. Des. 328,117 discloses the design of a combined golf club head cleaner and divot repair tool.

In this respect, the retractable divot repair tool according to the present invention substantially departs from the conventional concepts and designs of the prior art, and in doing so provides an apparatus primarily developed for the purpose of retractably supporting a divot repair tool in a container of the type capable of being used as a key ring, money clip or the like.

Therefore, it can be appreciated that there exists a continuing need for a new and improved retractable divot repair tool which can be used for retractably supporting a divot repair tool in a container of the type capable of being used as a key ring, money clip or the like. In this regard, the present invention substantially fulfills this need.

SUMMARY OF THE INVENTION

In view of the foregoing disadvantages inherent in the known types of retractable tools of a wide variety of designs and configurations now present in the prior art, the present invention provides an improved retractable divot repair tool. As such, the general purpose of the present invention, which will be described subsequently in greater detail, is to provide a new and improved retractable divot repair tool and method which has all the advantages of the prior art and none of the disadvantages.

To attain this, the present invention essentially comprises a new and improved retractable divot repair tool assembly comprising, in combination, a divot repair tool of an essentially rigid material in a generally planar configuration, the tool having long parallel side edges, a short linear bottom edge coupling the side edges and an upper edge formed in a generally V-shaped configuration, the upper portion including sloping interior edges in the general shape of a V with curved upper corner edges terminating at the upper side edges and with a generally circular interior acute angle at the lower portion of the sloping edges and with the lower portion of the tool being in a generally rectangular configuration of a length slightly less than the length of the upper V-shaped portion with an aperture therethrough and a recess in the aperture; a housing in a generally box-like configuration having rectangular front and rear walls, a bottom wall at right angles with respect thereto and parallel side walls coupling the side edges of the front and rear walls and the side edges of the bottom wall, the container having an opened upper end, the container also having a longitudinal slot on the front wall along the majority of its length thereof parallel with the side walls and with short upper and lower transverse slots adjacent to the upper end and lower end of the longitudinal slot; coupling mechanisms including a slide block reciprocable within the container between an upper extended orientation and a lower retracted orientation with a threaded aperture on its exterior side and a recess on its interior side; a button having an enlarged head shiftable along the length of the longitudinal slot by an operator, the button having an interior projection with an exterior threaded surface threadably secured to the threaded aperture of the slide block for the movement thereof; and a spring in a generally J-shaped configuration having a short extent with an upper free end secured within the recess of the slide block and having a second free end at its long end secured within the recess of the aperture of the divot repair tool to urge the slide block away from the divot repair tool, the slide block being of a size to be urged outwardly from the container and into the upper transverse recess when in the operative position and into the lower transverse recess when in the inoperative position.

There has thus been outlined, rather broadly, the more important features of the invention in order that the detailed description thereof that follows may be better understood and in order that the present contribution to the art may be better appreciated. There are, of course, additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of descriptions and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent of legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new and improved retractable divot repair tool which has all the advantages of the prior art retractable tools of a wide variety of designs and configurations and none of the disadvantages.

It is another object of the present invention to provide a new and improved retractable divot repair tool which may be easily and efficiently manufactured and marketed.

It is further object of the present invention to provide a new and improved retractable divot repair tool which is of durable and reliable construction.

An even further object of the present invention is to provide a new and improved retractable divot repair tool which is susceptible of a low cost of manufacture with regard to both materials and labor, and which accordingly is then susceptible of low prices of sale to the consuming public, thereby making such retractable divot repair tool economically available to the buying public.

Still yet another object of the present invention is to provide a new and improved retractable divot repair tool which provides in the apparatuses and methods of the prior art some of the advantages thereof, while simultaneously overcoming some of the disadvantages normally associated therewith.

Still another object of the present invention is to retractably support a divot repair tool in a container of the type capable of being used as a key ring, money clip or the like.

Lastly, it is an object of the present invention to provide a new and improved retractable divot repair tool assembly comprising a divot repair tool in a generally planar configuration, the tool having long parallel side edges, a short linear bottom edge coupling the side edges and an upper portion formed in a generally V-shaped configuration and with the lower portion of the tool being in a generally rectangular configuration of a length slightly less than the length of the upper V-shaped portion with an aperture therethrough and a recess in the aperture; a housing in a generally box-like configuration having rectangular front and rear walls, a bottom wall at right angles with respect thereto and parallel side walls coupling the side edges of the front and rear walls and the side edges of the bottom wall, the container having an opened upper end, the container also having a longitudinal slot on the front wall along the majority of its length thereof parallel with the side walls and with short upper and lower transverse slots adjacent to the upper end and lower end of the longitudinal slot; and mechanisms to move the divot repair tool between a stored orientation within the container and an operative orientation exterior of the container.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein:

FIG. 1 is a perspective view of a divot repair tool constructed in accordance with a prior art design.

FIG. 2 is another divot repair tool within the body of prior art.

FIG. 5 is a cross-sectional view taken along line 5—5 of FIG. 3.

FIG. 6 is an enlarged illustration of the spring and associated components taken at circle 6 of FIG. 5.

The same reference numerals refer to the same parts through the various Figures.

DESCRIPTION OF THE PREFERRED EMBODIMENT

Figure 3:
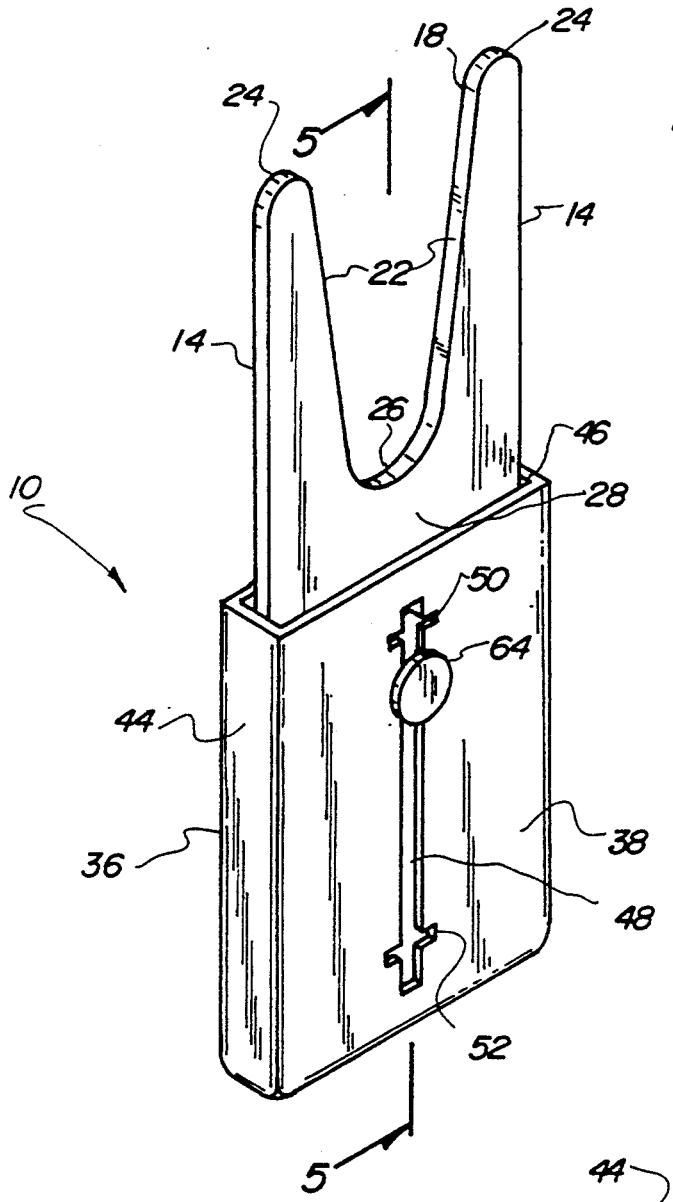
FIG. 3 is a perspective illustration of the preferred embodiment of the new and improved retractable divot repair tool constructed in accordance with the principles of the present invention.
Figure 4:
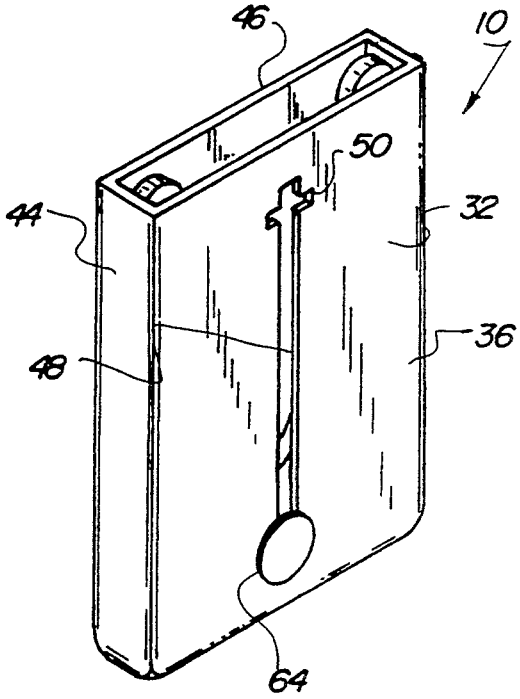
FIG. 4 is a perspective view similar to FIG. 3 but with the tool in the retracted orientation.

With reference now to the drawings, and in particular to FIG. 1 thereof, the preferred embodiment of the new and improved retractable divot repair tool embodying the principles and concepts of the present invention and generally designated by the reference numeral 10 will be described.

The present invention, the new and improved retractable divot repair tool, is a system 10 comprised of a plurality of components. Such components, in their broadest context, include a tool, a housing, coupling mechanisms, a button and a spring. Such components are individually configured and correlated with respect to each other so as to attain the desired objective.

The tool 10 of the present invention is a system. Its central component is the divot repair tool 12. Such tool is of an essentially rigid material as for example a rigid plastic. It is in a generally planar configuration. The tool has long parallel side edges 14. It also has a short linear bottom edge 16 coupling the side edges. It also has an upper edge 18 formed in a generally V-shaped configuration.

The upper edge 20 includes sloping interior edges 22. These are in a generally V-shaped configuration. They have curved upper corner edges 24. Such edges terminate at the upper side edges. The tool 12 also has a generally semi-circular interior acute angle 26 at the lower portion of the sloping edges. It also has a lower portion 28. Such lower portion of the tool is in a generally rectangular configuration. It is of a length slightly less than the length of the upper V-shaped portion. The rectangular portion has an aperture 32 therethrough. A recess 34 is formed in the aperture. The purpose will be later described.

Next provided as a central component of the tool of the system 10 is a housing 36. Such housing is in a generally box-like configuration. It has rectangular front and rear walls 38 and 40. A bottom wall 42 is at right angles with respect to the front and rear walls. Parallel side walls 44 couple the side edges of the front and rear walls and the side edges of the bottom wall.

The container has an opened upper end 46. It also has a longitudinal slot 48 on the front wall. Such longitudinal slot extends along the majority of the length of the front wall. It is configured midway between and parallel with the side walls. Formed in association with the longitudinal slot are a pair of short upper and lower transverse slots 50 and 52. Such transverse slots are located adjacent to the upper end and lower end of the longitudinal slot.

Next provided are coupling mechanisms between the housing and the tool. Such coupling mechanisms include a slide block 56. The slide block is reciprocable within the container between an upper extended orientation and a lower retracted orientation. A threaded aperture 58 is formed on the exterior side of the recess 60 on its interior side.

Next provided as part of the coupling mechanisms is a button 64. The button has an enlarged head 66. The button and head are shiftable along the length of the longitudinal slot by an operator. The button has an interior projection 68 with an exterior threaded surface 70. The threaded surface is removably secured to the threaded aperture of the slide block for effecting the concurrent movement thereof.

Lastly provided is a spring 74 as part of the coupling mechanism. The spring is in a generally J-shaped configuration. It has a short extent 76. The short extent has an upper free 78 secured within the recess of the slide block. It also has a second free end 80 at its long end. Such second free end is secured within the recess of the aperture of the divot repair tool. The spring functions to urge the slide block away from the divot repair tool. The slide block is of a size so as to be urged outwardly from the container into the upper transverse slot when in the operative position and it is also adapted to be urged into the lower transverse slot when in the inoperative position.

Figure 7:
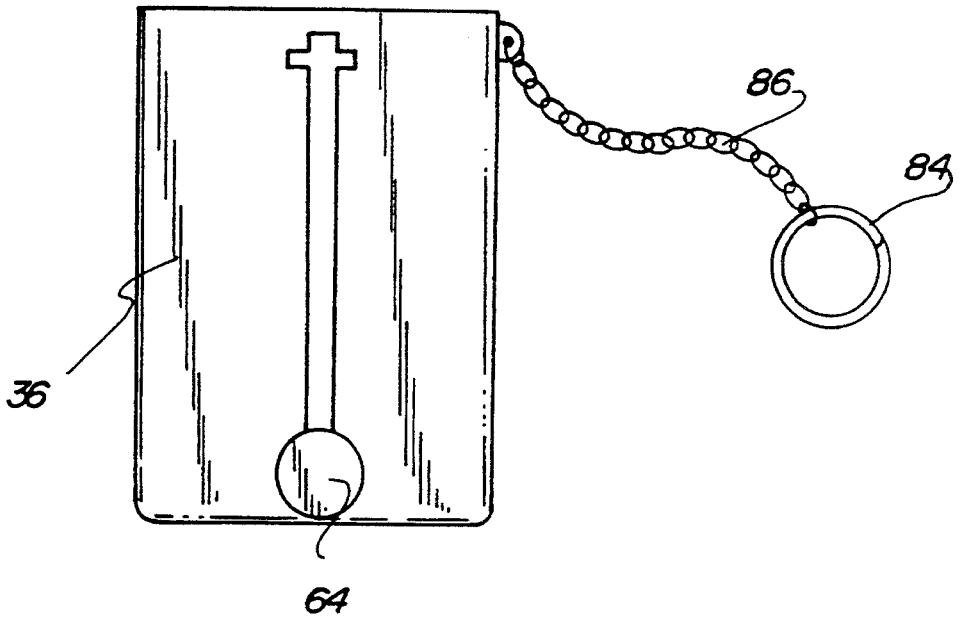
FIG. 7 is a front elevational view of the tool of the prior FIGS. 3–6 but illustrating an alternate embodiment of the invention.
Figure 8:
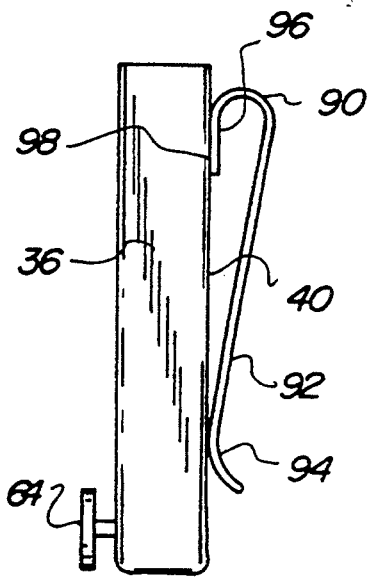
FIG. 8 is a side elevational view of a divot repair tool constructed in accordance with a further alternate embodiment of the invention.

Alternate embodiments of the invention are shown in FIGS. 7 and 8. In the FIG. 7 embodiment, the housing 36 is provided with a shiftable button 64. It is also provided with a rigid loop 84 fabricated preferably of metal. The rigid loop is for supporting a quantity of keys. In association therewith, a chain 86 has a first end secured to the loop and a second end secured to the housing. In this manner, the divot repair tool assembly may be used as a key ring. In the second alternate embodiment, the housing 36 with its shiftable button 64 is fabricated again as in the primary embodiment. In addition, however, an inverted U-shaped clip 90 is fabricated. Such clip is of a rigid material, preferably metal. It has a long end 92 terminating in a free end 94. The free end is spring-urged towards the container. The clip also has a short end 96 with the free end 98 secured to the container. In this manner, money may be positioned between the J-shaped member and the U-shaped member clip 90 and the container 36.

Figure 9:
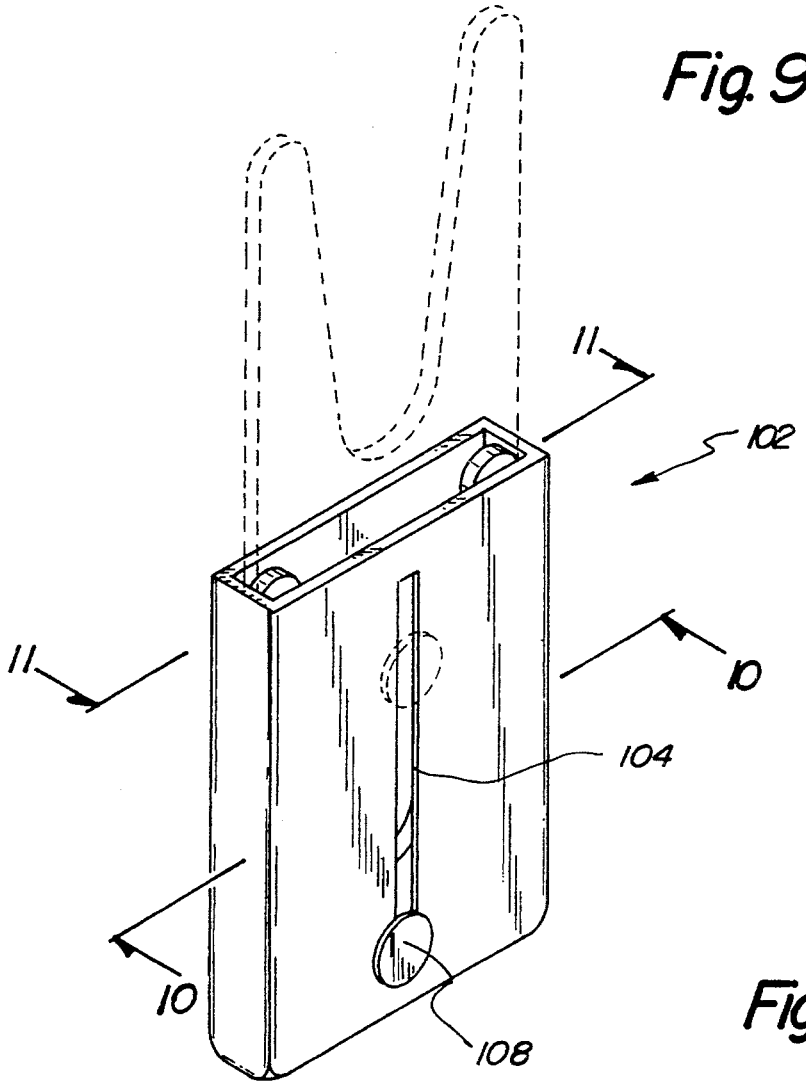
FIG. 9 is a perspective view of another alternate embodiment of the invention.
Figure 10:
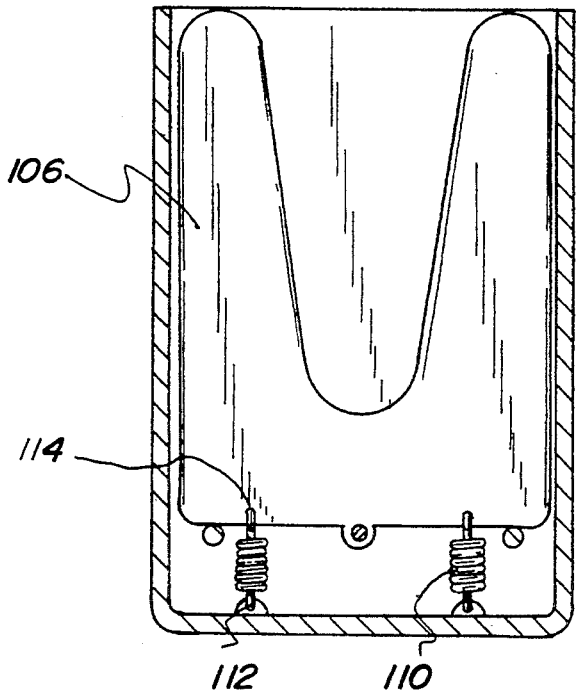
FIG. 10 is a cross-sectional view taken along line 10—10 of FIG. 9.
Figure 11:
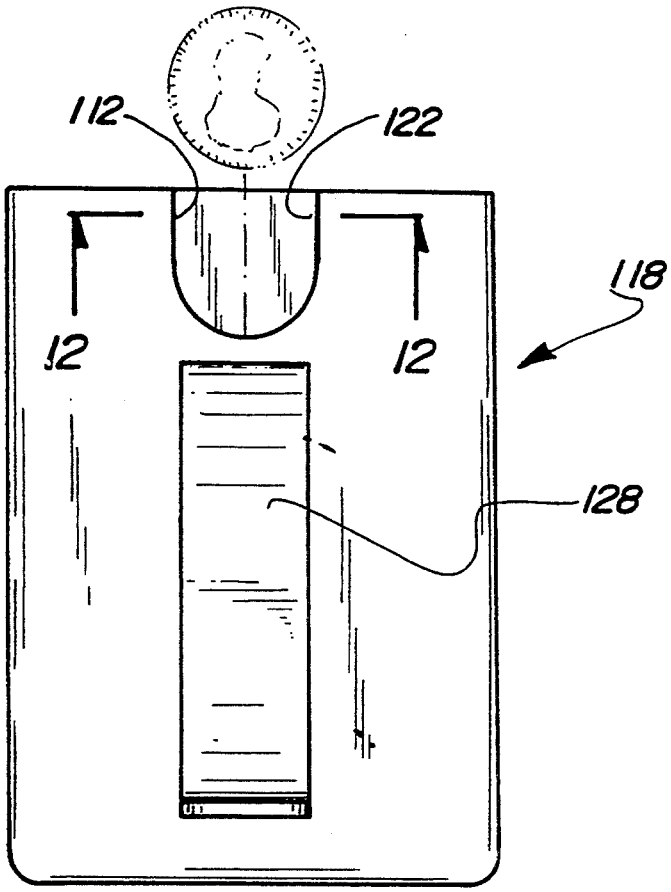
FIG. 11 is a cross-sectional view taken along line 11—11 of FIG. 9.
Figure 12:
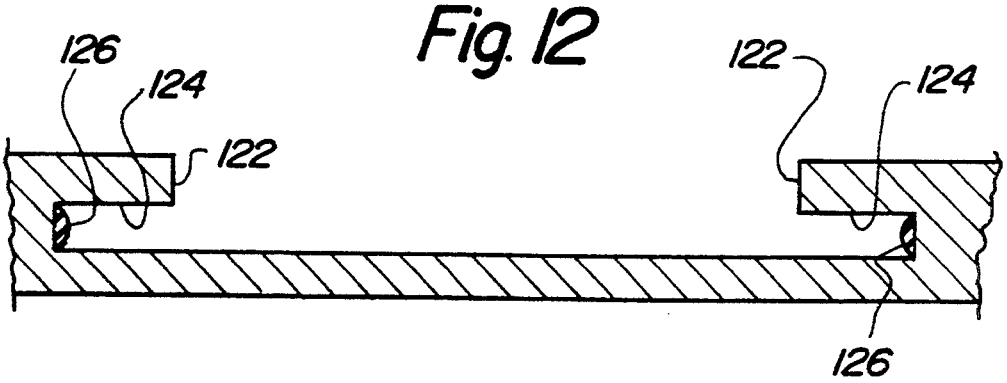
FIG. 12 is a cross-sectional view taken along line 12—12 of FIG. 11.

An alternate embodiment of the invention is shown in FIGS. 9 through 12. In such embodiment, the retractable divot repair tool 102 is formed with a slot 104. Such slot is shown without the transverse slots 52 at the upper and lower extents of the vertical slot 104. Such transverse slots could, however, be utilized in such embodiment if desired. A button 108 is adapted to move the tool upwardly to the dotted line position as shown in FIG. 9. The button 108 is also adapted to move to the retracted position as shown in FIG. 10. The retraction is effected through a pair of coil springs 110. Such coil springs are coupled at their lower ends 112 through a hook at the end of a spring to an apertured projection extending upwardly from the lower extent of the housing. The upper extents of the springs 114 are also formed with hooks received within apertures at the lower extents of the tool. As such, when not urged forwardly by a user pushing the button 108, the tool will be automatically retracted to a position within the housing.

Another feature of this alternate embodiment is a recess formed on the rear wall 118 of the housing, the wall having the slot 104. Such recess has parallel sides 122. Such parallel edges extend downwardly a short distance and then form a curve generally concentric with a coin or ball marker adapted to be received and supported therein. Within the undercut section 124 of the recess is an elastomeric member 126. The exposed surface of the elastomeric member is adapted to contact the ball marker positioned therein to assist in retaining it in the intended position.

The last feature of such alternate embodiment is a clip 128 positioned on the rear wall of the housing. Such clip is of a configuration similar to that shown in FIG. 8 as a technique for extending the utility of the device by holding folded paper money in a convenient orientation for the benefit of the user.

The present invention could replace all other such tools and devices. If a golfer does not carry a divot repair tool, they probably use a golf tee. They dig the point down into the ground, around the disturbed area to loosen it up, because it has been compacted by the impact of the golf ball. They compact the repaired turf so it is flat and smooth, without edges or depressions. Some carry tiny tools for the purpose, usually handouts from companies promoting their products. If they have larger and more elaborate gadgets that also perform other functions, like tightening golf spikes, they may be placed on the golf cart.

So much for repairing the divots, but that does not address what happens to the trouser or shorts pockets in which these items are carried. Anyone who has ever played golf more than a few times knows that they all put holes in the pockets. Since quality golf trousers are very expensive, creating holes in the pockets with pointed repair tools makes no sense.

The best solution to this problem is offered in the present invention. It offers a simple device, made of plastic or metal, which has a pointed retractable tool. When retracted, it snaps into a locked position, concealed in a well-rounded case which does not damage the pocket. Depressing a protruding button permits the blade to be pushed out and may or may not be locked in the extended position, with the point exposed, ready for the divot repair.

The present invention could also be a fob on a key chain, money clip or the like. Of course, this device also presents a great opportunity for sales promotion.

As to the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by Letters Patent of the United States is as follows:

1. A new and improved retractable divot repair tool assembly comprising, in combination:

a divot repair tool of an essentially rigid material in a generally planar configuration, the tool having long parallel side edges, a short linear bottom edge coupling the side edges and an upper edge formed in a generally V-shaped configuration, the upper edge including sloping interior edges in the general shape of a V with curved upper corner edges terminating at the upper side edges and with a generally circular interior acute angle at the lower portion of the sloping edges and with the lower portion of the tool being in a generally rectangular configuration of a length slightly less than the length of the upper V-shaped portion with an aperture therethrough and a recess in the aperture;

a housing in a generally box-like configuration having rectangular front and rear walls, a bottom wall at right angles with respect thereto and parallel side walls coupling the side edges of the front and rear walls and the side edges of the bottom wall, the container having an opened upper end, the container also having a longitudinal slot on the front wall along the majority of its length thereof parallel with the side walls and with short upper and lower transverse slots adjacent to the upper end and lower end of the longitudinal slot;

coupling mechanisms including a slide block reciprocable within the container between an upper extended orientation and a lower retracted orientation with a threaded aperture on its exterior side and a recess on its interior side;

a button having an enlarged head shiftable along the length of the longitudinal slot by an operator, the button having an interior projection with an exterior threaded surface threadably secured to the threaded aperture of the slide block for the movement thereof; and a spring in a generally J-shaped configuration having a short extent with an upper free end secured within the recess of the slide block and having a second free end at its long end secured within the recess of the aperture of the divot repair tool to urge the slide block away from the divot repair tool, the slide block being of a size to be urged outwardly from the container and into the upper transverse recess when in the operative position and into the lower transverse recess when in the inoperative position.

2. A retractable divot repair tool comprising:

a divot repair tool in a generally planar configuration, the tool having long parallel side edges, a short linear bottom edge coupling the side edges and an upper portion formed in a generally V-shaped configuration and with the lower portion of the tool being in a generally rectangular configuration of a length slightly less than the length of the upper V-shaped portion with an aperture therethrough and a recess in the aperture;

a housing in a generally box-like configuration having rectangular front and rear walls, a bottom wall at right angles with respect thereto and parallel side walls coupling the side edges of the front and rear walls and the side edges of the bottom wall, the container having an opened upper end, the container also having a longitudinal slot on the front wall along the majority of its length thereof parallel with the side walls and with short upper and lower transverse slots adjacent to the upper end and lower end of the longitudinal slot; and mechanisms to move the divot repair tool between a stored orientation within the container and an operative orientation exterior of the container.

3. The device as set forth in claim 2 wherein the mechanisms include:

coupling mechanisms including a slide block reciprocable within the container between an upper extended orientation and a lower retracted orientation with a threaded aperture on its exterior side and a recess on its interior side;

a button having a head shiftable along the length of the longitudinal slot, the button having an interior projection with an exterior threaded surface threadably secured to the threaded aperture of the slide block for the movement thereof; and a spring in a generally J-shaped configuration having a short extent with an upper free end secured within the recess of the slide block and having a second free end at its long end secured within a recess located within the aperture of the divot repair tool to urge the slide block away from the divot repair tool, the slide block being of a size to be urged outwardly from the container and into the upper transverse recess when in the operative position and into the lower transverse recess when in the inoperative position.

4. The device as set forth in claim 2 and further including:

a rigid loop for supporting a quantity of keys and a chain having a first end secured to the loop and a second end secured to the housing.

5. The device as set forth in claim 2 and further including:

an inverted U-shaped clip of a resilient material having a long end terminating in a free end spring urged toward the container and having a short end with a free end secured to the container whereby money may be positioned between the J-shaped member and the container.

6. The device as set forth in claim 2 and further including a pair of springs located within the housing, the springs coupled at their lower ends to the bottom wall and at their upper ends to the tool for urging the tool into a position within the housing.

7. The device as set forth in claim 2 and further including:

a recess formed in the side wall opposite the longitudinal slot adjacent to the upper end, the recess having downwardly extending parallel walls and a curved lower edge, the recess being formed with an undercut periphery for receiving and supporting a disk-shaped ball marker therein.

8. The device as set forth in claim 7 and further including an elastomeric member within the undercut region for frictionally retaining the ball marker within the recess.

* * * * *